United States Patent [19]

Kavaloski et al.

[11] 4,266,305

[45] May 12, 1981

[54] WHEELCHAIR FOR TRANSPORTATION VEHICLES

[75] Inventors: Peter P. Kavaloski, Los Angeles; Thomas K. Hale, Glendale, both of Calif.

[73] Assignee: Lockheed Corporation, Burbank, Calif.

[21] Appl. No.: 94,397

[22] Filed: Nov. 14, 1979

[51] Int. Cl.[3] ..... A47K 11/06

[52] U.S. Cl. ..... 4/480; 4/254; 4/479; 297/DIG. 4; 297/6; 297/353

[58] Field of Search ..... 4/254, 480, 479; 280/242 WC, 289 WC; 297/DIG. 4, 188, 42, 5, 6, 353; 308/184 R

[56] References Cited

U.S. PATENT DOCUMENTS

| | | | |
|---|---|---|---|
| 2,869,614 | 1/1959 | Wamsley | 4/480 X |
| 3,061,368 | 10/1962 | Matthews | 4/480 X |
| 3,062,582 | 11/1962 | Baldwin | 4/480 X |
| 3,215,469 | 11/1965 | Wamsley | 4/480 X |
| 3,611,449 | 10/1971 | Berry | 4/480 |
| 4,028,749 | 6/1977 | James | 4/480 |
| 4,177,528 | 12/1979 | James | 4/254 X |

*Primary Examiner*—Henry K. Artis

*Attorney, Agent, or Firm*—Lowell G. Turner

[57] ABSTRACT

A wheelchair for the transportation of a disabled person throughout the cabin of a transportation vehicle and into a lavatory of the vehicle having a bench type toilet, the wheelchair having a seat stabilizer extendable therefrom to engage the top surface of the toilet, a translating seat assembly for the disabled person with a seat opening transferable over the toilet opening, and a slidable foot rest for the person during transportation on the vehicle and when using the toilet. To prevent sidewise tipping, stabilizer bars can be moved outwardly from the sides of the seat assembly to engage the top surface of the toilet.

20 Claims, 11 Drawing Figures

Fig. 4
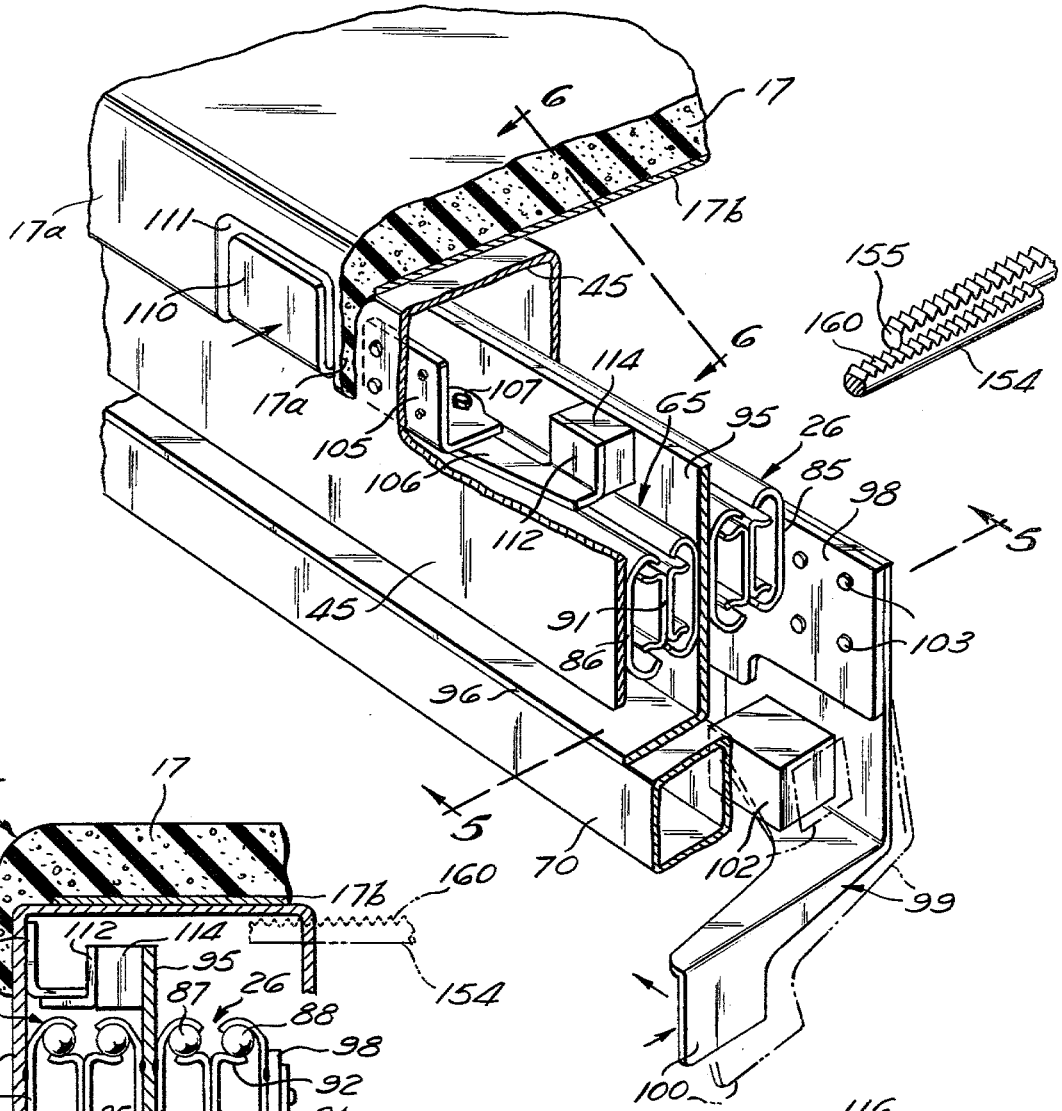
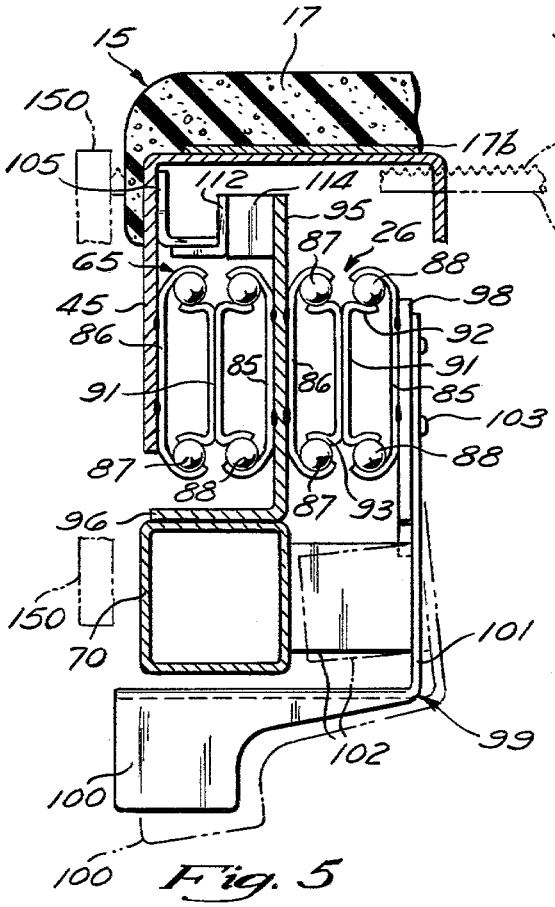
Fig. 5
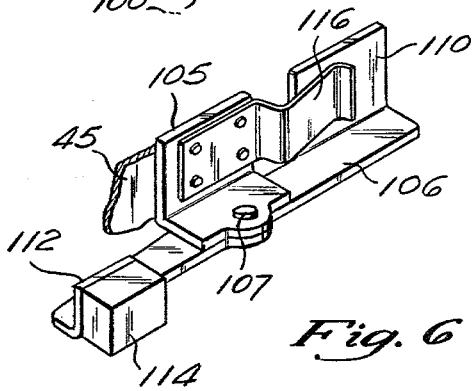
Fig. 6

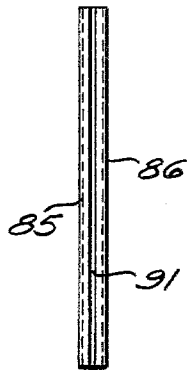
Fig. 9A
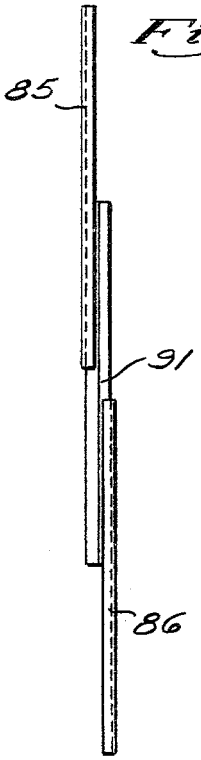
Fig. 9B
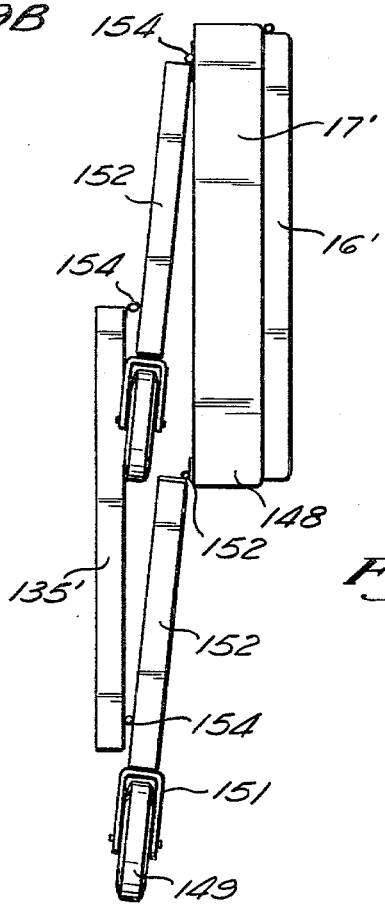
Fig. 10
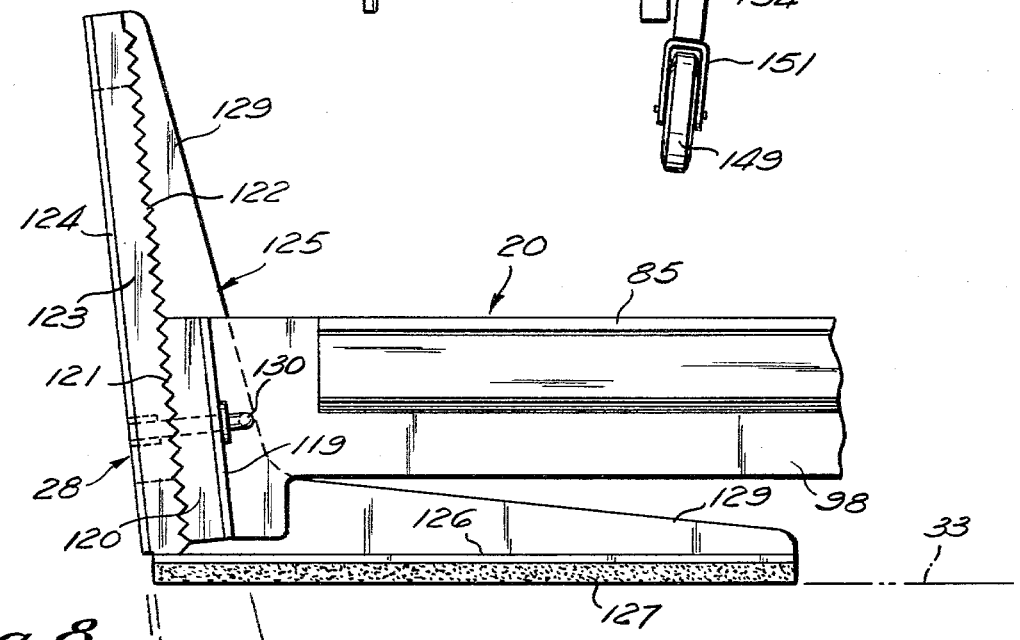
Fig. 8
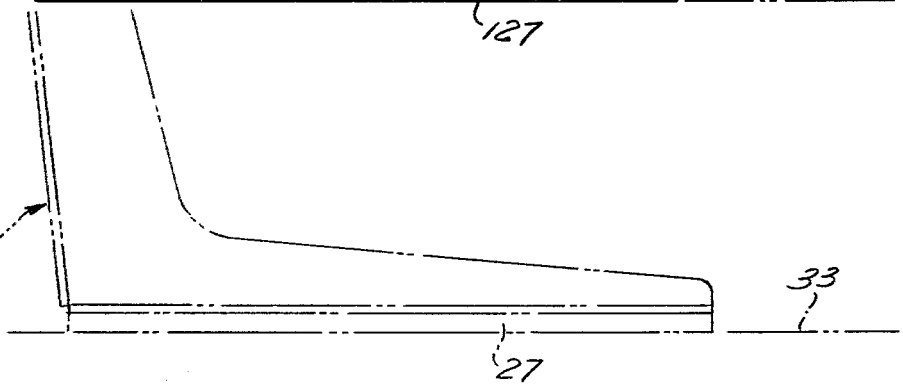

WHEELCHAIR FOR TRANSPORTATION VEHICLES

TECHNICAL FIELD OF THE INVENTION

The field of the invention relates to a wheelchair for the transportation of a disabled person throughout the cabin of a transportation vehicle and into the lavatory of the vehicle which contains a bench type toilet.

BACKGROUND OF THE INVENTION

Bench type toilets are commonly found in various transportation vehicles such as passenger aircraft, trains and buses and lodging facilities. In these types of vehicles, the aisles are normally very narrow and the lavatories are in very confined areas. The mobility of disabled persons has been increasing in recent years to include not only social and business life, but travel as well. Where once a disabled individual was expected to restrict travel away from home, today these special people are travelling around the world to conduct business or to vacation. The need for travel mobility felt by the disabled has been frustrated due to the lack of proper facilities and equipment aboard transportation vehicles. Over the years, seat cost per mile has become paramount in the financial success of a company and has increasingly dictated the size and shape of passenger vehicle interiors.

Hence, narrow aisles, small lavatories and restricted use of transportation vehicle facilities has limited travel by the disabled communities. While many designs for wheelchairs have been offered for use by the disabled aboard vehicles, they generally suffer from one or more disadvantages. Some require that the disabled passenger be limited to a number of seats adjacent the wide aisles, and are too large to enter a lavatory to place the occupant over a toilet. Conventional wheelchairs for toilet use, such as illustrated in U.S. Pat. Nos. 2,592,405; 4,052,087 and 4,067,409, straddle the common type toilet, and these cannot be used in vehicles with bench type toilets. The bench type toilets are enclosed in their lower extremities by a shroud which eliminates the straddling capability of wheelchairs of this type. Two wheel conveyances for the disabled must be tilted back to lift front supports off the floor and to allow forward motion. The tilting feature is objectionable to many of the disabled because the rotation of the chair transfers control from the disabled to the person navigating. Also, variation of the chair attitude due to the difficulty of controlling forward motion and position is unnerving to many.

Other special devices have been used for moving the disabled. For instance, in U.S. Pat. No. 635,575 to Ecole, dated July 12, 1977, there is disclosed a transfer device which moves an invalid from a bed to a wheelchair and vice-versa, by means of a platform mounted on rails. The leg support and foot rest of the device must be elevated to a horizontal position before the person may begin the transfer and the person must be in a horizontal position during this transfer. Another such device is illustrated in U.S. Pat. No. 2,648,849 to N. B. Wass, et al, dated Aug. 18, 1953. This device provides a means for positioning an occupant over a bathtub to take a shower. The patient is transferred from a wheelchair to an invalid chair and then translated over the bathtub. Also, U.S. Pat. No. 3,413,667 to D. T. Swain, dated Dec. 3, 1968, describes a combination of stretcher table and chair for transporting an occupant within a hospital or similar facility. It is convertible to either a wheelchair, litter or table. However, there is no suggestion that this apparatus could be used in a toilet.

SUMMARY OF THE INVENTION

The wheelchair of this invention functions within the confines of transportation vehicles to provide the disabled with travel mobility throughout the cabin. It permits a disabled person to be transported down a narrow aisle of a vehicle into a small lavatory and into and out of confined areas. In the case of passenger aircraft, it provides transportation from the passenger cabin entry to the passenger seat; from the seat to the lavatory; translation of the chair occupant over the toilet within the lavatory; and return of the passenger to his seat.

When the wheelchair is positioned forward of a bench type toilet, the wheelchair utilizes a translating seat assembly that enables the occupant to be transferred from the wheelchair to the toilet while remaining seated. Prior to the translation of the occupant, a seat stabilizer is withdrawn from the wheelchair and pushed over the shroud of the bench type toilet. The stabilizer engages the top of the shroud to prevent the translated seat and wheelchair from tipping when the occupant is moved into position over the toilet seat. The translating seat has an opening which can be located over the toilet opening and the seat opening is normally covered by a hinged seat cover so that when the patient is being moved around in the vehicle for other than toilet purposes, the hinged seat cover will be the surface upon which the patient will be seated. However, when it is desired to take the patient to the lavatory, and before loading the patient on the wheelchair, the hinged seat cover will be raised so that the patient will be seated directly over the seat opening. Thereafter, the patient will be moved on the wheelchair into the lavatory for translation over the toilet opening. The size of the wheelchair has been made small enough so that it will enter the door of the lavatory in an aircraft and can be rotated within the lavatory to place the wheelchair opposite the bench toilet shroud so that the seat stabilizer can be pulled out and into engagement with the shroud at opposite sides of the toilet opening. The seat stabilizer stabilizes the wheelchair against tipping and thereafter, the translating seat assembly can be moved to place the seat opening over the toilet opening for use of the toilet by the occupant. The seat stabilizer is adjustable to accomodate various heights of toilet shrouds in order to provide the desired stability to the wheelchair and prevent tipping of the wheelchair during the transfer of the seat assembly over the shroud. A stabilizer bar is extendable from each side of the seat assembly for engagement with the top surface of the toilet shroud or other adjacent structure to prevent sidewise tipping of the seat assembly should the disabled person reach to one side or the other while positioned above the toilet opening.

A slidable foot rest is provided below the translating seat assembly and is positioned forward of the wheelchair so that the feet of the occupant can rest upon the foot rest during transportation of the occupant. During movement of the translating seat assembly over the toilet opening, the foot rest will also move rearwardly toward the shroud so that it will still support the occupant's feet when in position to use the toilet. Armrests attached to the seat back of the wheelchair which can be rotated up and out of the way in order to allow the occupant to enter or leave the wheelchair from the side as well as the front, and to prevent squeezing the occupant. The seat back is adjustable to satisfy the needs of the disabled when adjusting clothing before use of the toilet. Various attachments can be provided, such as an electric drive system to convert the wheelchair into an electrically powered vehicle. Also, a foldable structure could be provided for folding the wheelchair for storage within a carrying case for ease of handling when transferring from one transportation vehicle to another.

Thus, the present invention is specifically designed to take care of the needs of the disabled since it functions within the confines of a transportation vehicle to provide the disabled with travel mobility throughout the cabin including the lavatory and permits use of the bench type toilet in the lavatory which cannot be accomplished by previous devices.

BRIEF DESCRIPTION OF THE DRAWINGS

FIG. 4 is a perspective view partly in section of the front left corner when facing the wheelchair of FIG. 1;

FIG. 5 is a section along line 5—5 of FIG. 4 showing the tracks for the translating seat assembly and for the seat stabilizer;

FIG. 6 is a perspective view of the latch for controlling movement of the seat assembly;

FIG. 8 is a side elevational view of the adjustable foot for the seat stabilizer as illustrated in FIG. 7.

FIGS. 9A and 9B are top plan views illustrating the closed position and the extended position, respectively, of the slide assemblies used for the translating seat assembly, the seat stabilizer and the foot rest;

FIG. 10 is a side elevational view of a modification of the wheelchair in which the legs are hinged to the foot rest and to the seat assembly to permit the wheelchair to be folded for transportation purposes.

DESCRIPTION OF THE PREFERRED EMBODIMENT

Figure 1:
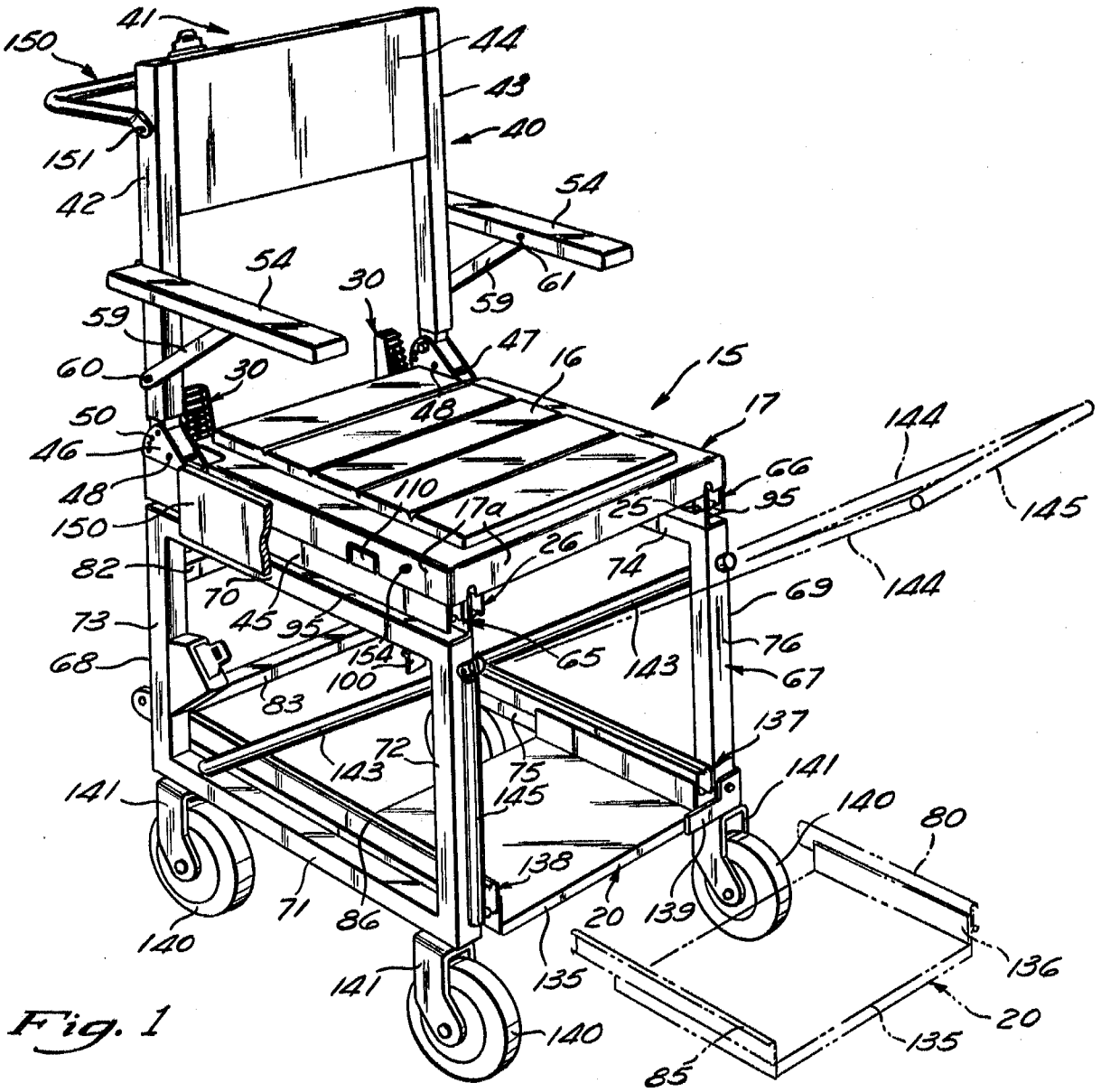
FIG. 1 is a perspective view of the wheelchair of the present invention with the seat cover in the lowered position to cover the seat opening.
Figure 2:
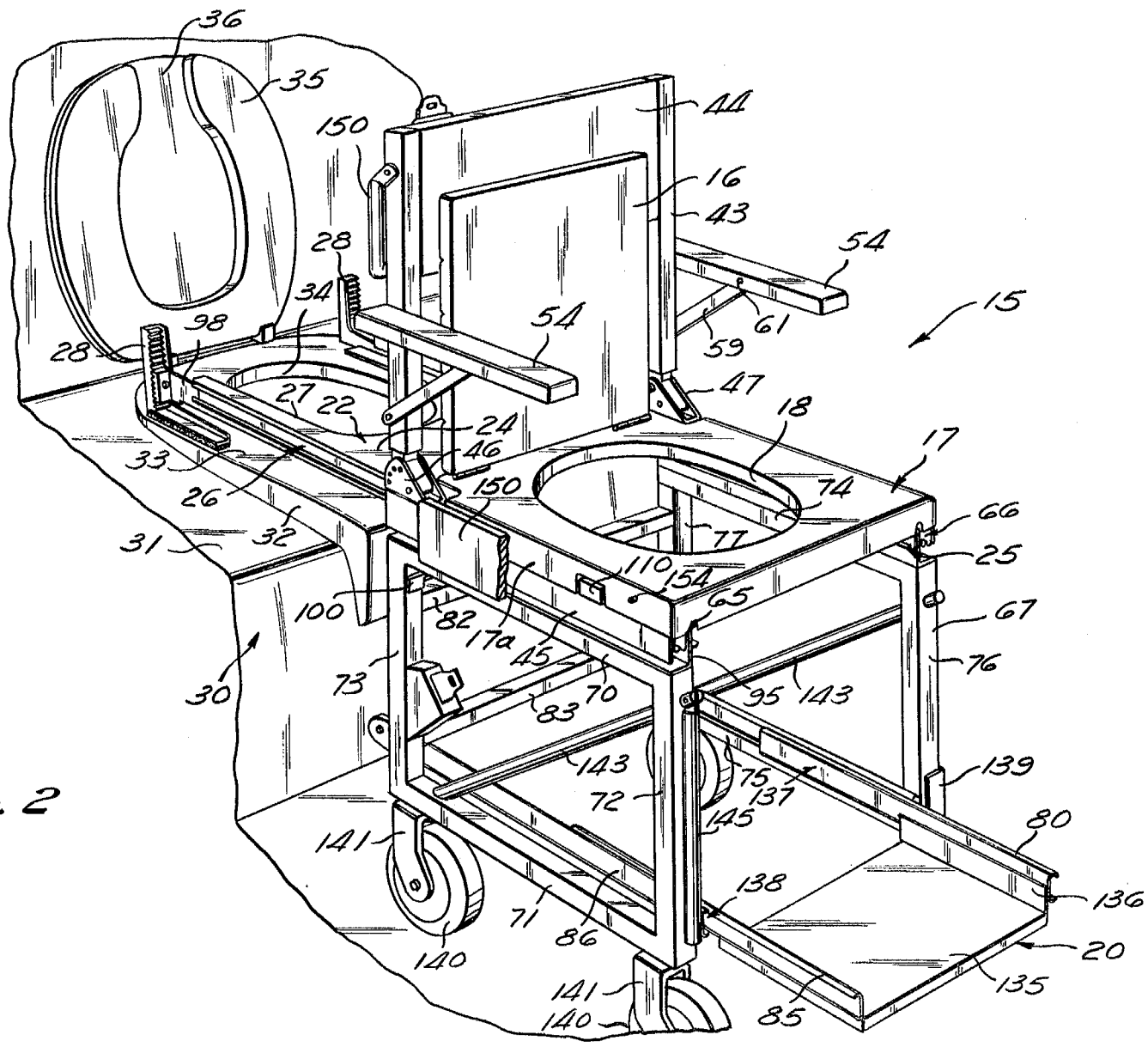
FIG. 2 is a perspective view similar to FIG. 1 with the seat stabilizer engaging the toilet shroud on opposite sides of the toilet opening.

Referring to FIG. 1, the translating seat assembly 15 of wheelchair 14 is shown in its normal position for transporting the occupant throughout a vehicle, such as an aircraft. A hinged seat cover 16 covers the top of foam seat 17 having four sides 17*a*. A movable foot rest 20 is shown below seat 17 in its stowed position, while in the dotted line position, it is shown in position to support the feet of a person who has been placed on seat 17. As illustrated in FIG. 2, the seat cover 16 has been raised showing seat opening 18. A seat stabilizer 22 is normally located below seat top 17 and is shown in its extended position in FIG. 2. The stabilizer 22 consists of a plate 24 connecting between two slide assemblies 25 and 26 and the plate 24 contains cut out 27 which extends rearwardly to the rear end of the stabilizer. The end of each of the slide assemblies 25 and 26 carries a support foot 28 which engages the shroud at opposite sides of the toilet seat opening of the shroud and each of the support feet 28 are adjustable in height as will be later explained.

As illustrated in FIG. 2, the wheelchair 14 has been rolled into position opposite and adjacent the bench type toilet shroud 30 which has a top surface 31 and an upwardly projecting toilet seat 32 terminating in a flat toilet surface 33 surrounding a toilet opening 34. Such a shroud encloses the lower extremities of the toilet in most aircraft lavatory configurations presently in use and is placed over a waste tank module. A toilet seat 35 and cover 36 normally covering the toilet opening are shown in the raised position in FIG. 2, where they are positioned prior to the extension of the seat stabilizer 22.

Referring to FIG. 1, a seat back 40 comprises upright arms 42 and 43 which are connected with a back rest 44 extending between the top of the legs. Seat 17 is supported by two rigid support members 45 located at opposite sides of the seat and each connected to a bottom seat panel 17*b*. The members 45 support adjusting brackets 46 and 47 at each rear corner of the seat. A pin 48 (see FIG. 7) extending through each of the brackets pivotally supports the ends of the legs 42 and 43. Also, each of the brackets contain a plurality of adjusting openings 50 which receive an adjusting pin 51 which also passes through the end of each of the legs. Thus, depending upon which pair of the openings 50 the pins 51 are inserted, the inclination of the seat back can be varied as illustrated in the dashed line position of FIG. 7. Each of the legs 42 and 43 pivotally support an arm 54 by means of a pivot 55 located in a downward extension 56 of the arm. Also, each arm has a lug 57 extending to the rear of each of the legs to prevent the arms 54 from pivoting downwardly below the horizontal position while still permitting the arms to be raised. The arms 54 are normally held in the horizontal position by the links 59 which are pinned to the legs by pins 60 and are pivoted to the arms by pins 61. Thus, when a pin 61 is removed the corresponding arm can be raised into the dashed position of FIG. 7. By rotating either arm 54 up and out of the way, this allows the disabled person to enter or leave the wheelchair from the side as well as from the front. Also, by having the seat back adjustable, the occupant can recline to a position which is most comfortable for the adjustment of his clothing prior to use of the toilet.

Figure 3:
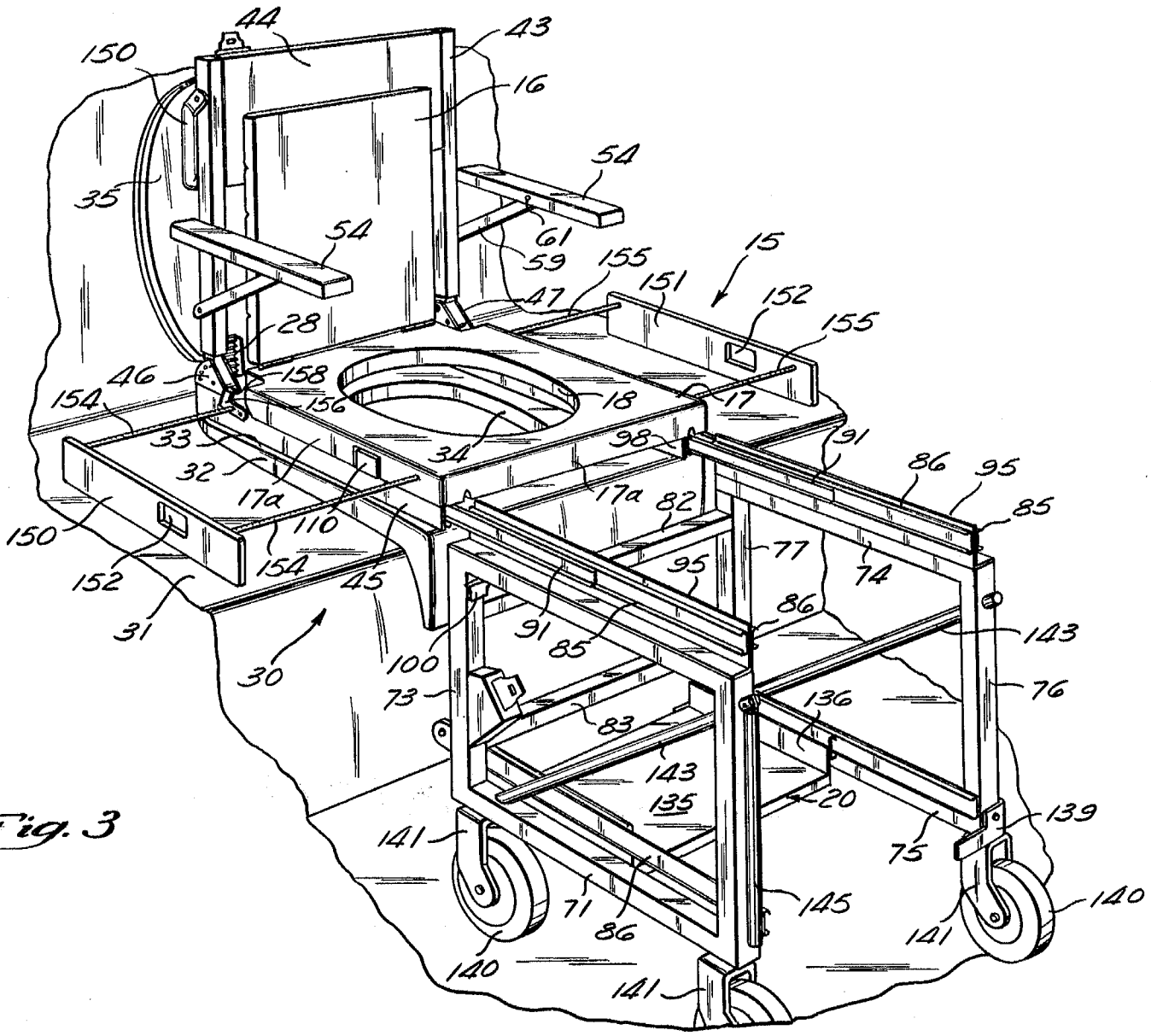
FIG. 3 is a perspective view similar to FIG. 1 illustrating the seat assembly located over the seat stabilizer and the toilet opening.

Referring to FIG. 3, the translating seat assembly 15 has been moved rearwardly to place seat opening 18 over toilet opening 34 in the shroud and during this movement the seat is supported at opposite sides by slide assemblies 65 and 66 which are connected to frame 67 of the wheelchair. In its rearward movement, the seat assembly 15 moves across the slide assembly 22 but is not supported thereby. The purpose of slide assembly 22 is to stabilize the wheelchair against tipping as the seat assembly is moved rearwardly over the toilet opening. Frame 67 of the wheelchair comprises two rectangular shaped frame members 68 and 69. Frame member 68 has top and bottom horizontal legs 70 and 71, respectively, and front and back upright legs 72 and 73, respectively. Frame member 69 has an upper and lower horizontal legs 74 and 75 and front and rear upright legs 76 and 77. Rear upper and lower cross members 82 and 83 connect between the upright legs 73 and 77, respectively, for the purpose of holding the frame together.

Figure 7:
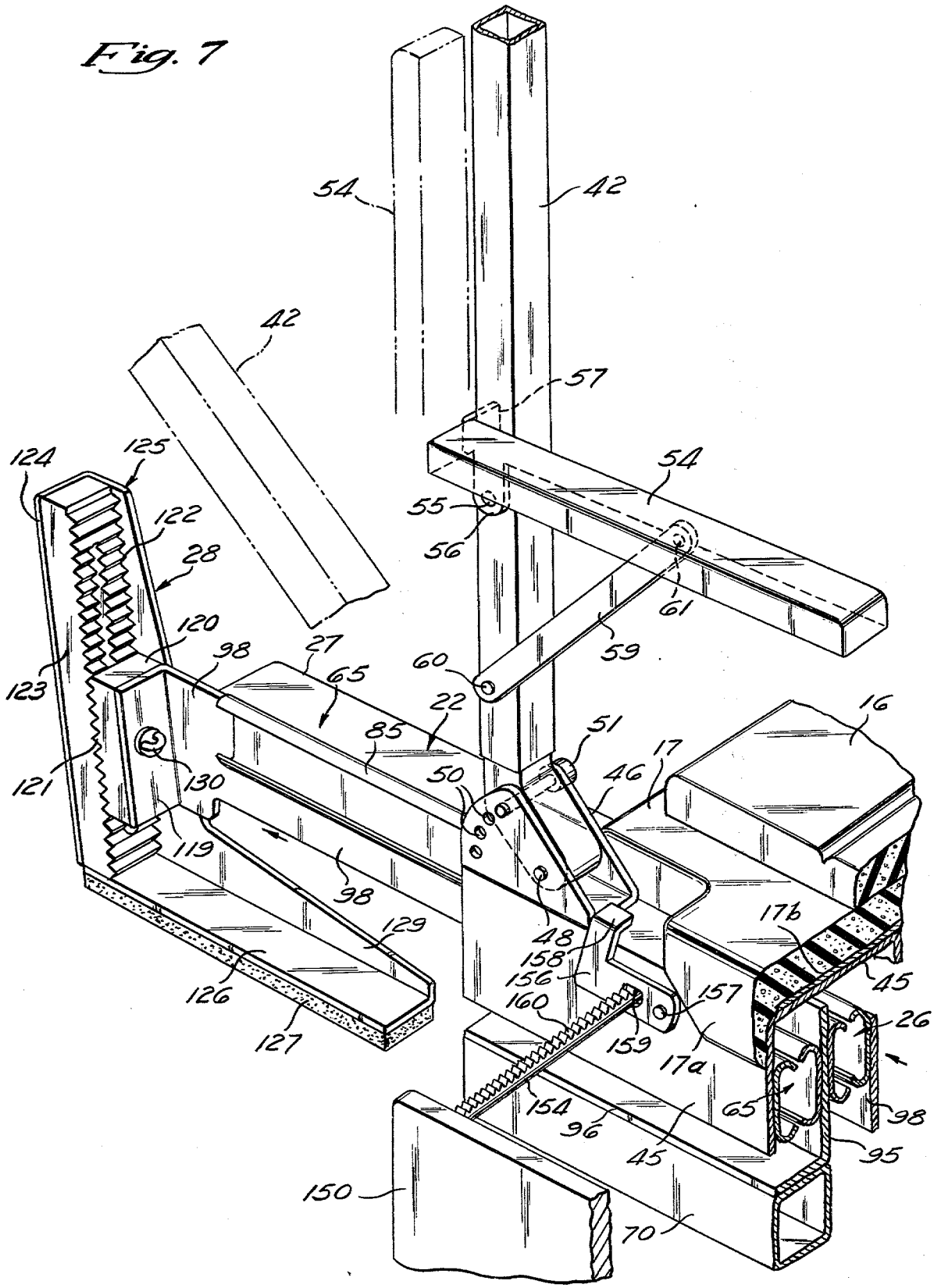
FIG. 7 is a partial perspective view illustrating one track for the seat stabilizer with the adjustable foot at its end.

The mountings at the left side of the wheelchair for the slide assembly 26 for the seat stabilizer 22 and for the slide assembly 65 for the translating seat assembly 15 are illustrated in FIGS. 4, 5 and 7 and it is understood that the mountings at the right side for the slide assemblies 25 and 66 are the same. Each of the slide assemblies is identical in structure and comprises two outside cover members 85 and 86 extending along each side of the seat and having upper and lower curved ends for receiving rows of ball bearings 87 and 88, respectively. A center member 91 has upper and lower ends for confining the ball bearings 87 and 88. An angle iron bracket 95 has a leg 96 secured to top member 70 of frame 68 and it is understood that a reversed bracket 95 is secured to the top member 74 of frame 69. The cover member 86 of slide assembly 26 and the cover member 85 of slide assembly 65 are welded to opposite sides of the upright portion of angle iron 95 so as to be rigid with the frame of the wheelchair. The outside cover member 86 of slide assembly 65 is welded to the rigid member 45 for the seat pad 17 and the outside cover member 85 of slide assembly 26 is welded to a mounting plate 98 which extends rearwardly as a part of the seat stabilizer assembly 22. It is understood that on the right hand side of the wheelchair, slide assembly 25 will be on the inside of a bracket 95 and slide assembly 66 will be on the outside of the bracket to support the outside edge of seat 17. Thus, the slide assemblies 25 and 26 are closest to one another on the inside of brackets 95 and slide assemblies 65 and 66 are on the outside of the bracket 95. The expanded and contracted condition of each of the slide assemblies is illustrated in FIGS. 9A and 9B, respectively, and it is pointed out that the cover members 85 and 86 and the center member 91 can be of the same length and, in the fully extended condition, approximately one-half of the center member 91 resides in each of the cover members 85 and 86. This structure is well known in the art and one such slide assembly is produced by Accuride, division of Standard Precision Inc.

In order to adjust the position of the seat stabilizer 22, each of the slide assemblies 25 and 26 have a brake 99 comprising a handle 100 located at the end of a spring steel plate 101 which carries a brake shoe 102 normally bearing against the side of frame member 70. The plate 101 is attached to mounting plate 98 by rivets 103. When it is desired to move the seat stabilizer 22 rearwardly to the position of FIG. 2, each handle 100 is gripped and pushed inwardly to the dashed line position thus bending the spring steel plate 101 and moving the friction pad 102 away from frame member in order to permit the inside member of the slide assembly to move rearwardly with mounting plate 98 into the position illustrated in FIG. 2. In most instances, the handles 100 will be operated by the attendant who accompanies the occupant of the wheelchair. With the seat stabilizer in the rear position, cut out 27 is large enough to clear the seat opening 18 and the toilet opening 34.

It is also desirable to have a brake to restrain the movement of the seat assembly 15 which can be operated by the seat occupant or attendant and such a latch is illustrated in FIGS. 4, 5 and 6. A bracket 105 is riveted to the side of each support member 45 on each side of the wheelchair and pivotally mounts a lever arm 106 by means of a pivot 107. One end of the arm 106 carries the finger actuated latch portion 110 which extends through an opening in the side of bracket 45 and the side 17*a* of seat 17. The other end of lever 106 opposite pivot 107 has an upright portion 112 carrying friction pad 114 which is located to engage the top extension of bracket 95 above the slide assembly 65. The lever 106 is biased by a leaf spring 116 which is rigid with bracket 105 and bears against the inside of portion 110. Thus, the pad 114 is continually biased against the bracket 95 to hold the seat assembly in its forward position as illustrated in FIG. 1 and the seat can be released for rearward movement into the position of FIG. 3 when finger pressure is applied to both portions 110. It is understood that a similar latch will be located on the opposite side of seat 17 and will engage the bracket 95 located on that side of the seat so that both latch portions 110 will have to be released before the seat will move.

When the seat stabilizer 22 is extended so that the cut out 27 is over the toilet opening 34, the ends of the mounting plates 98 to which the cover members of slide assemblies 25 and 26 are attached, carry the support feet 28. An end 119 of each plate 98 is secured to a block 120 having teeth 121 which cooperate with teeth 122 on the block 123 of the upright leg 124 of a frame 125. The lower side 126 of frame 125 supports a friction pad 127 which engages the flat toilet surface 33 adjacent the projecting seat 32. A lock pin 130 extends through end 119, blocks 120 and 123 and through the upright leg 124. When the pin is removed, the block 123 can be moved up and down by the attendant relative to the block 120 and when the surface 127 comes into engagement with the shroud surface 33, pin 130 is reinserted to hold the ends of mounting plate 98 of the seat stabilizer 22 in an elevation which will permit the slide assemblies 25 and 26 to extend straight out and steady the wheelchair. It is understood that the same adjustment will be made to the support foot 28 on the end of each of the mounting plates 98 on opposite sides of the seat stabilizer. The support feet 28 will move inwardly underneath the seat 17 when in the stowed position of FIG. 1. The dashed line position of FIG. 8 for foot 28 illustrates the manner in which the support feet can be moved up and down relative to the end of the mounting plates 98.

Referring to FIG. 1, the foot rest 20 comprises a plate 135 which is supported at its sides by plates 136 which are attached to a cover member of slide assemblies 137 and 138. Each of these slide assemblies is constructed in a similar manner to the other slide assemblies which have been previously described. Both of these slide assemblies 137 and 138 extend the length of the wheelchair and are in their intermediate positions when foot rest 20 is in the position shown in FIG. 1. From this position, the foot rest can be moved rearwardly to the rear end of the wheelchair (FIG. 3) or forwardly to extend out in front of the wheelchair as illustrated by the dotted line position of FIG. 1. Latches 139 connected to frame legs 76 and 77 are located opposite ends of the foot rest to prevent movement of the foot rest. However, the front latch can be pivoted out of the way to permit the foot rest to extend into the dashed line position of FIG. 1.

The chair is supported by four wheels 140 at each end of the wheelchair and the wheels are secured to brackets 141 which are pivoted to each lower corner of the frame in a well known manner. Also, a tube 143 is located on each side of the wheelchair and extends from lower frame legs 71 and 75 to the upper ends of the front upright legs 72 and 76. Arms 144 extend into the tubes 143 and arm 144 on the left side has a cross arm 145 pivoted thereto. In the stowed position, the cross arm 145 hangs downwardly in front of the leg 72. When the arms 144 are pulled out of the tubes 143, the cross arm 145 can be rotated so that the other end can be connected to the opposite arm 144. Thus, the cross arm 145 provides a handle in front of the wheelchair in order to move the wheelchair rearwardly. A handle 150 has its ends pivoted to the legs 42 and 43 of the back rest 40 by pivots 151 in each of the legs which permits the handle 150 to be extended rearwardly of the wheelchair for movement of the wheelchair.

In use of the wheelchair, the disabled person is met at the cabin door with the seat cover 16 in the down position and, if necessary, one or both of the arms 54 can be lowered to place the person in the chair. The wheelchair can then be moved down the aisle to a position opposite the person's seat so that the person can be moved from the front or side of the wheelchair onto the seat, again raising one or both of the arms 54 if necessary. When the end of the trip is reached, the person can be picked up in the wheelchair from the seat and moved to the door of the cabin. If, in the meantime, the person desires to go to the restroom, an attendant will bring the wheelchair alongside the person's seat. At this time, the seat cover 16 will be raised into position shown in FIG. 2 and a covering material can be located over the seat opening 18 prior to locating the disabled person over the seat opening. Such a cover could be used for aesthetic purposes and can be easily removed after the wheelchair is in the lavatory. The wheelchair is then moved down the aisle and has small enough dimensions so that it can move through the door of the lavatory and turned so that the rear part of the wheelchair abuts the shroud 31 of the toilet. Typical dimensions for the wheelchair would be 14½ inches wide, 18¾ inches long and 23¾ inches high to top of seat. During movement into the lavatory, foot rest 20 has been extended into the forward dashed position shown in FIG. 1 to support the feet of the person.

The attendant then pulls outwardly on the handle 100 on each side of the wheelchair and moves the seat stabilizer 22 rearwardly into the position shown in FIG. 2, where the lower pads 127 engage the toilet shroud surface 33 on opposite sides of the toilet seat. Before placing the person in the wheelchair it may be necessary for the attendant to adjust the height of the support feet 28 in order to align the slide assemblies for proper outward movement and wheelchair support. The purpose of the seat stabilizer 22 is to provide a support for the wheelchair against tipping rearwardly.

Next, either the occupant or the attendant can push inwardly on the side finger portions 110 to release the seat assembly 15 for rearward movement on the slide assemblies 65 and 66 into position over the toilet seat such that the seat opening 18 in the seat assembly is over the toilet opening 34. At the same time, foot rest 20 will be moved rearwardly to the rear position on the slide assemblies 137 and 138 so that the foot rest continually supports the feet of the occupant when positioned for use of the toilet. Prior to placing the person in the wheelchair, the seat back 41 can be tilted rearwardly to facilitate the occupant arranging clothing prior to using the toilet. While the seat assembly is over the toilet opening, it is supported over the seat stabilizer by slide assemblies 65 and 66. An additional stabilizing mechanism for the seat assembly can be provided to prevent sideway tipping of the seat when the person reaches to the side while located over the toilet opening for some reason, such as to utilize the sink. The mechanism can comprise stabilizing bars 150 and 151 mounted along each side **17*a* of the seat assembly and each containing an opening 152 through which the latch portion 110 can be reached. The stabilizer bar 150 is mounted by a pair of slidable rods 154 and stabilizer bar 151 is mounted by a pair of slidable rods 155. Each stabilizer bar passes through aligned openings in the two sides of one bracket 45 (see FIG. 6) and the rods for the bars are staggered from each other at opposite ends (see FIG. 4). In FIG. 3, the bar 150 is shown in extended position engaging the top surface 31 of shroud 30 to prevent tipping to the left and the retracted position of the bars 150 and 151 is adjacent side 17*a* of the seat assembly. In order to lock the rods in an extended position, a lock lever 156 is pivoted to each side of bracket 45 by a pivot 157 and each lever has a gripping end 158 which extends above the rear end of bracket 45. An enlarged opening in member 156 for rod 154 has a top flat knife edge surface 159 which engages serrated surface 160 on the top surface of rod 154 in order to hold the stabilizing bar 150 in any selected extending position. The engagement of edge 159 is maintained by gravity, or a spring (not shown) could be utilized for this purpose. In order to properly engage surface 31**, the bars can be vertically adjustable on the end of the rods to accomodate various surface heights and shapes.

After the occupant is finished, the wheelchair will be operated in the reverse manner to first move the stabilizing bars inwardly and the seat assembly forwardly onto the wheelchair while the foot rest also moves forwardly to extended position in front of the wheelchair. The seat support stabilizer 22 will then be moved off the toilet and into storage in the wheelchair itself. The wheelchair is then ready to move the occupant back to his seat.

By the use of the adjustable support feet on the seat stabilizer, the wheelchair can be accomodated to various toilet heights. Also, as indicated, the wheelchair can be converted from the lavatory mode to the transport mode, permitting its use in narrow aisles of passenger aircraft, buses, trains, etc.

In the modification of the wheelchair illustrated in FIG. 10, the seat 17' and foot rest 135' can be attached to the ends of four upright legs 152 by means of the pivots 154. Thus, the modified wheelchair can be folded for easy storage within the vehicle when not in use or for transportation from one vehicle to another. Also, an electrical drive system could be attached to the wheelchair to convert it into an electrically powered vehicle. It is obvious that other additions and modifications can be made to the wheelchair while still performing its basic operations as described.

What is claimed is:

1. A wheelchair for transporting a disabled person into position over a toilet opening in the shroud of a bench type toilet comprising:

a frame mounted on wheels;

a seat stabilizer mounted on said frame by first slide means for movement of said seat stabilizer outwardly of said frame to an outward position;

a translating seat assembly mounted on said frame by second slide means for movement of said seat assembly outwardly of said frame to an outward position and located above said seat stabilizer;

a cut out in said seat stabilizer and an opening in said seat assembly, both located over said toilet opening when said seat stabilizer and then said seat assembly are moved to said outward positions; and said seat stabilizer having means at the end thereof for engaging said shroud on opposite sides of said toilet opening after said seat stabilizer has been moved to its outward position to prevent tipping of said frame upon movement of said seat assembly to its outward position.

2. A wheelchair as defined in claim 1 comprising:

a foot rest mounted on said frame below said seat assembly by third slide means for movement below said frame to a rearward position and outwardly of said frame to an outward position;

said foot rest moving rearwardly with the feet of said disabled person below said frame when said seat assembly is moved over said toilet seat and movable outwardly of said frame when said seat assembly is above said frame.

3. A wheelchair as defined in claim 1;

said first slide means comprises a first pair of slide assemblies secured to the opposite sides of said frame at the top thereof and extendable from a position in said frame outwardly to said outward position of said seat stabilizer.

4. A wheelchair as defined in claim 1;

said second slide means comprises a second pair of slide assemblies secured to opposite sides of said frame at the top thereof, said second slide means being extendable from a position in said frame outwardly to said outward position of said seat assembly.

5. A wheelchair assembly as defined in claim 2;

said third slide means comprising a third pair of slide assemblies secured to opposite sides of said frame and supporting opposite sides of said foot rest, said third pair of slide assemblies being positioned below said first and second pair of slide assemblies.

6. A wheelchair assembly as defined in claim 4;

said seat assembly being secured to a pair of support members on opposite sides of said frame, each of said support members being secured to one of said second pair of slide assemblies.

7. A wheelchair as defined in claim 6 comprising a hinged seat cover on said seat assembly for covering said seat opening when said wheelchair is being used solely for transportation purposes.

8. A wheelchair as defined in claim 6;

said second pair of slide assemblies each comprising two outside cover members and a separate intermediate member, one of said cover members being secured to one of said support members for movement with said seat assembly, the other of said cover members being rigid with said frame.

9. A wheelchair as defined in claim 3;

said first pair of slide assemblies each comprising two outside cover members and an intermediate member, one of said cover members being rigid with said frame, said seat stabilizer comprising a pair of mounting plates secured to the other cover members of said pair.

10. A wheelchair as defined in claim 9; an adjustable support foot secured to the end of each of said mounting plates for engaging said shroud when said seat stabilizer is in its outward position in order to maintain said first pair of slide assemblies in alignment and support said frame against tipping when said seat is in its outward position.

11. A wheelchair as defined in claim 1 comprising a seat back extending upwardly from the rear end of said seat assembly and means for adjusting the tilt of said seat back to facilitate adjustment of clothing of said person for use of said toilet.

12. A wheelchair as defined in claim 11 comprising arms located on opposite sides of said seat back for maintaining the disabled person on said seat assembly; and arms being rotatable upwardly to permit said person to enter said seat assembly from either side of said wheelchair.

13. A wheelchair as defined in claim 12, a first handle movable upwardly from the back of said seat back for pushing of said chair, and a second handle extending forwardly from said wheelchair to facilitate pushing the wheelchair from the front thereof.

14. A wheelchair for transporting a disabled person into position over a toilet opening in the shroud of a bench type toilet comprising:

a frame mounted on wheels;

a seat stabilizer mounted on said frame by first slide means for movement of said seat stabilizer outwardly of said frame to an outward position;

a translating seat assembly mounted on said frame by second slide means for movement of said seat assembly outwardly of said frame to an outward position and located above said seat stabilizer;

a cut out in said seat stabilizer and an opening in said seat assembly, both located over said toilet opening when said seat stabilizer and then said seat assembly are moved to said outward positions;

said seat stabilizer having means at the end thereof for engaging said shroud on opposite sides of said toilet opening after said seat stabilizer has been moved to its outward position to prevent tipping of said frame upon movement of said seat assembly to its outward position;

a foot rest mounted on said frame below said seat assembly by third slide means for movement below said frame to a rearward position and outwardly of said frame to an outward position; and said foot rest moving rearwardly with the feet of said disabled person below said frame when said seat assembly is moved over said toilet seat and movable outwardly of said frame when said seat assembly is above said frame.

15. A wheelchair as defined in claim 14;

said first slide means comprises a first pair of slide assemblies secured to the opposite sides of said frame at the top thereof and extendable from a position in said frame outwardly to said outward position of said seat stabilizer;

said second slide means comprises a second pair of slide assemblies secured to opposite sides of said frame at the top thereof, said second slide means being extendable from a position in said frame outwardly said outward position of said seat assembly;

said third slide means comprising a third pair of slide assemblies secured to opposite sides of said frame and supporting opposite sides of said foot rest, said third pair of slide assemblies being positioned below said first and second pair of slide assemblies.

16. A wheelchair as defined in claim 15, said first, second and third pair of slide assemblies, each comprising two outside cover members and a separate intermediate member, one of said cover members and said intermediate member being movable and said other cover member being rigid with said frame.

17. A wheelchair as defined in claim 1, comprising stabilizer means located at the side of said seat assembly and extendable outwardly to engage adjacent structure and prevent sidewise tipping of said seat assembly.

18. A wheelchair as defined in claim 17, said stabilizing means comprising a stabilizing bar extending along each side of said seat assembly in its retracted position and support means attached to each of said stabilizing bars and movable outwardly from each side of said seat assembly to locate said stabilizing bars outwardly of said seat assembly.

19. A wheelchair as defined in claim 18, locking means for locking said support means in a selected position.

20. A wheelchair as defined in claim 14, stabilizing means comprising a stabilizing bar extending along each side of said seat assembly in its retracted position, and support means attached to each of said stabilizing bars and movable outwardly from each side of said seat assembly to locate said stabilizing bars outwardly of said seat assembly.

* * * * *